US007699429B2

(12) United States Patent
Furuya

(10) Patent No.: US 7,699,429 B2
(45) Date of Patent: Apr. 20, 2010

(54) DROPLET EJECTION DEVICE, DROPLET EJECTION DEVICE CONTROL METHOD AND STORAGE MEDIUM STORING DROPLET EJECTION DEVICE CONTROL PROGRAM

(75) Inventor: Masami Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 11/807,979

(22) Filed: May 31, 2007

(65) Prior Publication Data

US 2008/0079761 A1 Apr. 3, 2008

(30) Foreign Application Priority Data

Oct. 3, 2006 (JP) ..... 2006-271773

(51) Int. Cl.
*B41J 29/393* (2006.01)

(52) U.S. Cl. ..... 347/19

(58) Field of Classification Search ..... 347/12, 347/13, 19, 14, 15; 358/504
See application file for complete search history.

(56) References Cited

U.S. PATENT DOCUMENTS 5,581,284 A * 12/1996 Hermanson ..... 347/43
6,554,387 B1 * 4/2003 Otsuki ..... 347/19

FOREIGN PATENT DOCUMENTS

JP 8-011327 1/1996
JP 2001-347699 12/2001

* cited by examiner

*Primary Examiner*—Lamson D Nguyen
(74) *Attorney, Agent, or Firm*—Fildes & Outland, P.C.

(57) ABSTRACT

The present invention provides a droplet ejection device that includes a head, a storage component and an alteration component. At the head, a plurality of nozzles, which eject droplets in accordance with image data representing an image, are arrayed over a width in a main scanning direction which is longer than a recording region width. The head forms a main scanning line with the droplets ejected from the nozzles. At the storage component, inclination information relating to an inclination of the main scanning line formed by the head with respect to a main scanning line that should ideally be formed is pre-stored. The alteration component, in accordance with the inclination information stored at the storage component, alters which nozzles are to eject droplets in accordance with the image data.

18 Claims, 13 Drawing Sheets

DROPLET EJECTION DEVICE, DROPLET EJECTION DEVICE CONTROL METHOD AND STORAGE MEDIUM STORING DROPLET EJECTION DEVICE CONTROL PROGRAM

CROSS-REFERENCE TO RELATED APPLICATION

This application is based on and claims priority under 35 USC 119 from Japanese Patent Application No. 2006-271773, filed Oct. 3, 2006.

BACKGROUND

1. Technical Field

The present invention relates to a droplet ejection device, a method of controlling the droplet ejection device, and a storage medium at which a droplet ejection device control program is stored.

2. Related Art

As droplet ejection devices which eject liquid droplets, for example, inkjet printers which eject ink droplets as liquid droplets from nozzles are widely known.

A common inkjet printer is provided with a recording head featuring numerous nozzles for ejecting ink drops. For example, main scanning direction dot rows (main scanning lines) are recorded on a recording medium by a recording head at which nozzles are arrayed over a predetermined length in a recording medium width direction (for example, a length of at least the width of a recording region corresponding to the recording medium width), sub-scanning is implemented by the recording medium relatively moving with respect to the recording head in a direction perpendicular to the recording medium width direction, and thus an image is formed on the recording medium.

In such an inkjet printer, if a mounting position of the recording head is misaligned, the main scanning lines will become inclined relative to the intended main scanning lines.

Accordingly, a technology has been proposed in which, in order to compensate for a printing misalignment in a direction of relative movement of a recording head and a recording medium (i.e., the sub-scanning direction) without altering the position of the recording head, ink ejection timings are altered and thus the printing misalignment in the direction of relative movement of the recording head and the recording medium due to inclination of the recording head is corrected for.

SUMMARY

According to an aspect of the invention, there is provided a droplet ejection device that includes a head, a storage component and an alteration component. At the head, a plurality of nozzles, which eject droplets in accordance with image data representing an image, are arrayed over a width in a main scanning direction which is longer than a recording region width. The head forms a main scanning line with the droplets ejected from the nozzles. At the storage component, inclination information relating to an inclination of the main scanning line formed by the head with respect to a main scanning line that should ideally be formed is pre-stored. The alteration component, in accordance with the inclination information stored at the storage component, alters which nozzles are to eject droplets in accordance with the image data.

BRIEF DESCRIPTION OF THE DRAWINGS

Exemplary embodiments of the present invention will be described in detail based on the following figures, wherein.

DETAILED DESCRIPTION

Herebelow, examples of exemplary embodiments of the present invention will be described in detail with reference to the drawings.

First Exemplary Embodiment

Figure 1:
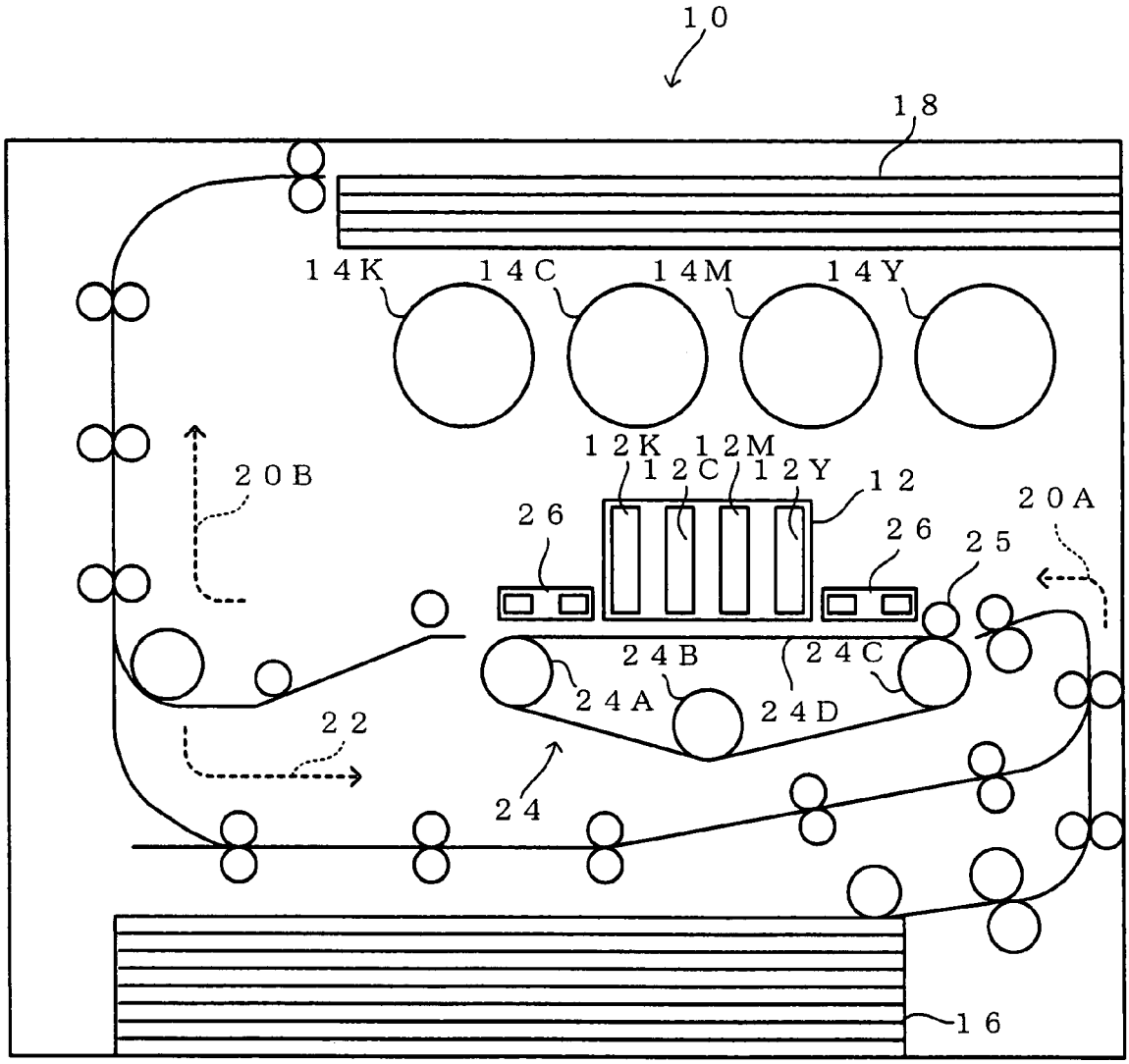
FIG. 1 is a diagram showing schematic structure of an inkjet printer relating to a first exemplary embodiment of the present invention.

FIG. 1 is a diagram showing schematic structure of an inkjet printer relating to a first exemplary embodiment of the present invention.

As shown in FIG. 1, an inkjet printer 10 is provided with recording heads 12 (12Y, 12M, 12C and 12K) for the colors Y (yellow), M (magenta), C (cyan) and K (black), which are arranged from an upstream side of a direction of conveyance of paper P. Ink tanks 14Y to 14K, which accommodate inks of the respective colors to be supplied to the recording heads 12, are provided in correspondence with the recording heads 12 of the respective colors. Herebelow, where descriptions are to be given without particularly distinguishing between the recording heads 12Y to 12K and the ink tanks 14Y to 14K of the respective colors, the letters Y to K are omitted from the ends of the reference numerals and a recording head 12 and ink tank 14 are referred to.

The inkjet printer 10 is further provided with a paper supply section 16, an endless belt-form conveyance body 24, a paper ejection section 18 and maintenance units 26. The paper supply section 16 accommodates paper P as a recording medium. The conveyance body 24 is disposed facing the recording heads 12 and conveys the paper P. The paper ejection section 18 ejects the paper P after printing. The maintenance units 26 clean nozzles of the recording heads 12.

The inkjet printer 10 is provided with plural conveyance rollers such that a first conveyance path and a second conveyance path 22 are formed. The first conveyance path is structured by a path 20A from the paper supply section 16 to the conveyance body 24 and a path 20B from the conveyance body 24 to the paper ejection section 18. The second conveyance path 22 reaches from the path 20B of the first conveyance path to the conveyance body 24, in a direction opposite to the direction of the path 20B.

Along the path 20A of the first conveyance path, the paper P from the paper supply section 16 is conveyed by the plural conveyance rollers to the conveyance body 24 one sheet at a time. Along the path 20B, the paper P is conveyed by the plural conveyance rollers to the paper ejection section 18. In the present exemplary embodiment, the second conveyance path 22 is provided to enable inversion of the paper P and two-sided printing.

The conveyance body 24 is provided with a driving roller 24A and a belt 24D. The belt 24D is wound around turning rollers 24B and 24C, which turn to follow rotation of the driving roller 24A. As a method for retaining the paper P with the conveyance body 24, electric adherence force can be employed. That is, the paper P is pressed against the belt by a charging roller 25, charge is provided to the paper P, and an adherence force is generated.

Each recording head 12 is structured by head units 86, (see FIG. 4) which are plurally linked together in a direction intersecting the paper conveyance direction (referred to as a main scanning direction) in a head bar with a length corresponding to a width of the paper P. The recording head 12 features a printing region corresponding to a maximum width of the paper P. At each head unit 86, nozzles which eject ink drops are plurally arranged in a direction the same as the direction of arrangement of the head units 86. In this inkjet printer 10, main scanning of the recording head 12 is not performed; the recording head 12 is kept fixed, and is capable of printing over the whole of the paper P while the paper P alone is conveyed. As inks to be used, various publicly known inks can be employed. For example, water-based inks, oil-based inks, solvent-type inks and so forth are applicable. The nozzles of each head unit 86 may be arrayed in a single row in the direction of arrangement of the head units 86, and may be arrayed in a plurality of rows so as to form a matrix; various methods of nozzle arrangement may be employed. The nozzles belonging to each head unit 86 eject droplets with predetermined timings corresponding to nozzle positions in a sub-scanning direction, and thus images corresponding to individual lines of inputted image data in the main scanning direction (i.e., main scanning lines) are formed on the recording medium. When the recording head 12 is mounted at a position according to design, the direction of the main scanning lines is a direction parallel to the main scanning direction. However, if, due to a mounting error or the like, there is a rotational misalignment of a mounting position of the recording head about an axis in a direction that intersects both the main scanning direction and the sub-scanning direction, the main scanning lines will not be parallel to the main scanning direction and the recording head will be inclined with respect to the main scanning direction.

The recording head 12 relating to the present exemplary embodiment is provided with nozzles in excess of the recording region in the paper width direction, which are used in a later-described correction of a reduction in a main scanning direction image width due to inclination of the recording head 12, or the like.

The maintenance units 26, which clean the recording heads 12, are disposed in the vicinity of the recording heads 12. The recording heads 12 are cleaned by the maintenance units 26, and ink blockages are prevented.

Figure 2A:
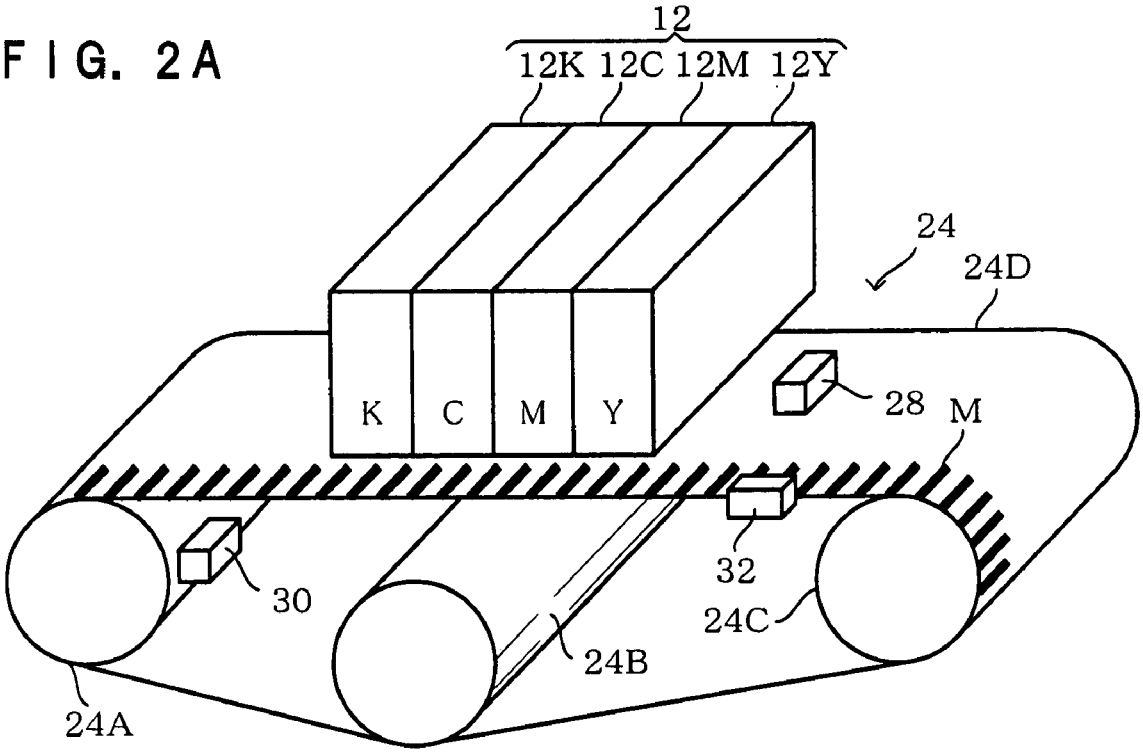
FIG. 2A and FIG. 2B are diagrams showing vicinities of recording heads.

As shown in FIG. 2A, a paper leading end detection sensor 28, which detects a leading edge of the paper P, is disposed at a paper conveyance direction upstream side of the recording heads 12. The leading edge of the paper P is detected by the paper leading end detection sensor 28, and the paper leading end detection sensor 28 controls printing timings of the recording heads 12 of the respective colors.

A driving roller home sensor 30 is disposed in a vicinity of the driving roller 24A for detecting a reference position of the driving roller 24A. A reference position of the belt 24D is detected by the driving roller home sensor 30.

Figure 2B:
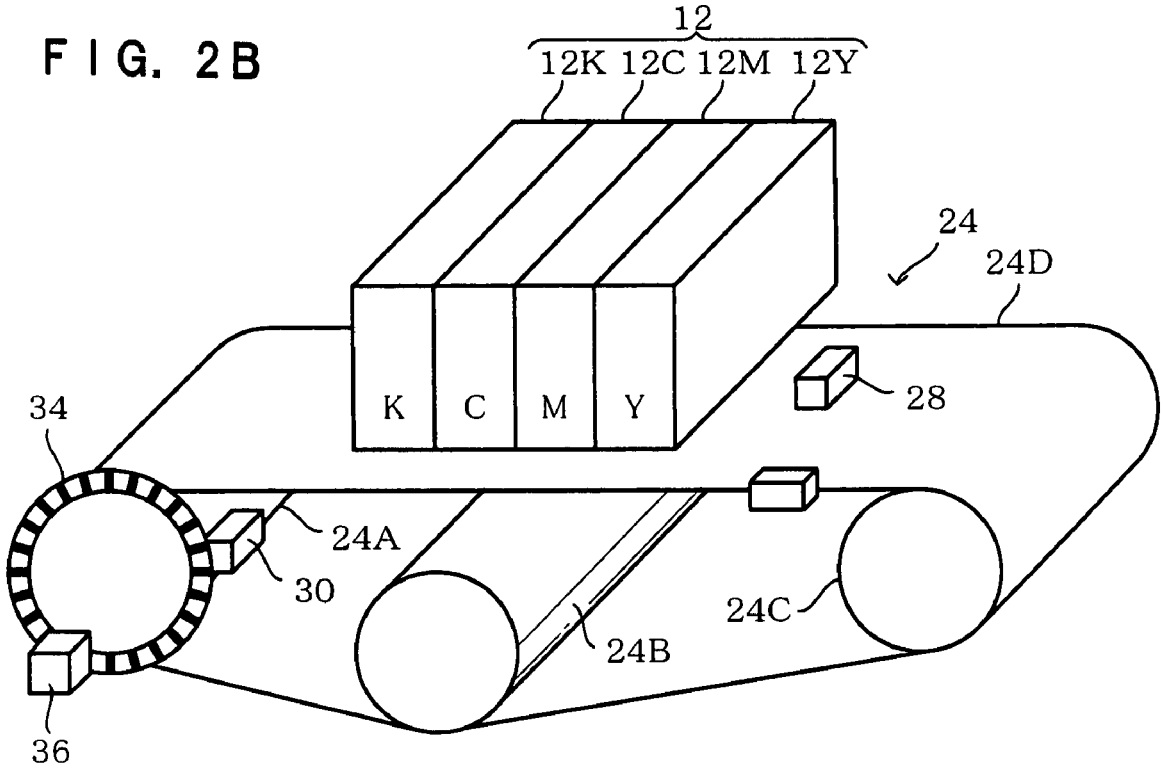

Furthermore, as shown in FIG. 2A, print timing marks M are provided on the belt 24D of the conveyance body 24, for generating a print timing clock. The print timing clock is generated by the print timing marks M being detected by a print timing sensor 32. The print timing clock could also be generated, as shown in FIG. 2B, by providing an encoder film (i.e., print timing marks) 34 coaxially at the driving roller 24A and reading the marks thereof with an encoder sensor 36.

Figure 3:
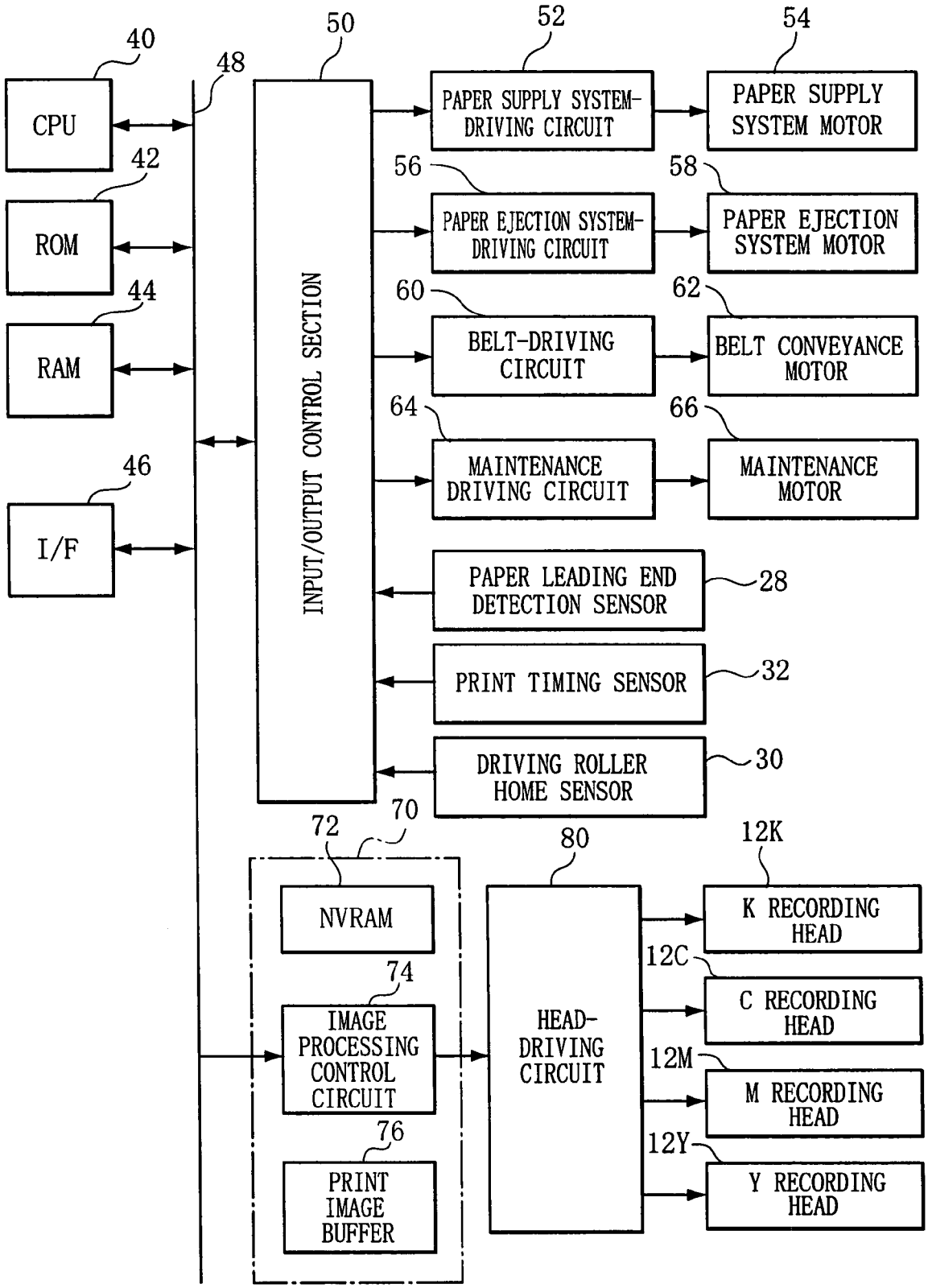
FIG. 3 is a block diagram showing structure of a control system of the inkjet printer relating to the first exemplary embodiment of the present invention.

FIG. 3 is a block diagram showing structure of a control system of the inkjet printer 10 relating to the first exemplary embodiment of the present invention.

The inkjet printer 10 relating to the first exemplary embodiment of the present invention is provided with a microcomputer in which a CPU 40, a ROM 42, a RAM 44, an interface (I/F) 46 and so forth are connected to a bus 48. Image data or the like is transmitted from a higher-level device such as a computer or the like and inputted through the interface 46, and the inkjet printer 10 performs printing.

An input/output control section 50 and a recording head control section 70 are also connected to the bus 48. The CPU 40 controls printing onto the paper P by controlling the input/output control section 50 and the recording head control section 70.

A paper supply system-driving circuit 52, a paper ejection system-driving circuit 56, a belt-driving circuit 60 and a maintenance driving circuit 64 are connected to the input/output control section 50.

A paper supply system motor 54, which drives the rollers of the path 20A and the like, is connected to the paper supply system-driving circuit 52. When the paper supply system motor 54 is driven by the paper supply system-driving circuit 52, the paper P is conveyed from the paper supply section 16 to the conveyance body 24.

A paper ejection system motor 58, which drives the rollers of the path 20B and the like, is connected to the paper ejection system-driving circuit 56. When the paper ejection system motor 58 is driven by the paper ejection system-driving circuit 56, the paper P is conveyed from the conveyance body 24 to the paper ejection section 18.

A belt conveyance motor 62, which drives the driving roller 24A of the conveyance body 24, is connected to the belt-driving circuit 60. When the belt-driving circuit 60 drives the belt conveyance motor 62, conveyance of the paper through the conveyance body 24 is implemented.

A maintenance motor 66, which drives the maintenance units 26, is connected to the maintenance driving circuit 64. When the maintenance driving circuit 64 drives the maintenance motor 66, cleaning of the recording heads 12 is carried out by the maintenance units 26. Thus, conveyance of the paper P. cleaning of the recording heads 12 and the like are implemented by the input/output control section 50 driving the respective driving circuits in accordance with instructions from the CPU 40.

The paper leading end detection sensor 28, the print timing sensor 32 and the driving roller home sensor 30 are also connected to the input/output control section 50. Detection results are inputted from the sensors, and printing is controlled by the CPU 40 in accordance with the detection results from the sensors.

Meanwhile, the recording head control section 70 is provided with an NVRAM (non-volatile RAM) 72, an image processing control circuit 74 and a print image buffer 76. The NVRAM 72 is a non-volatile memory which stores head inclination correction data, for correcting reductions of main scanning direction image widths which are caused by inclinations of the recording heads 12, to be described later. The image processing control circuit 74 generates printing data in which the main scanning direction image width reductions caused by inclinations of the recording heads 12 have been corrected for. The print image buffer 76 temporarily memorizes the printing data. The processed printing data is outputted to a head-driving circuit 80 by the image processing control circuit 74, and hence printing onto paper is implemented by the head-driving circuit 80 driving the recording heads 12 of the respective colors.

Figure 4:
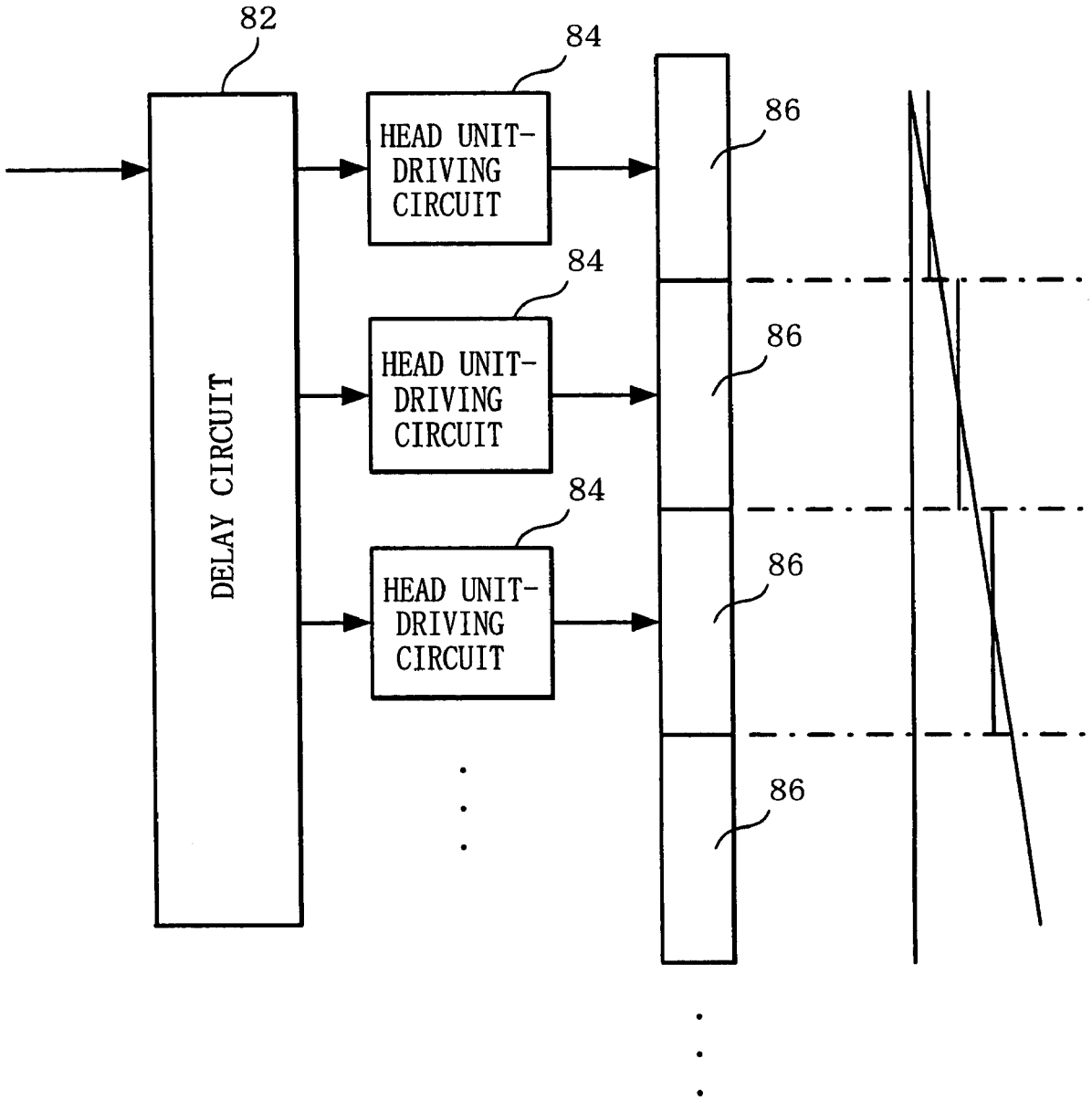
FIG. 4 is a block diagram showing structure of a head-driving circuit.

As is shown in more detail in FIG. 4, the head-driving circuit 80 is provided, for each color, with a delay circuit 82 and a plurality of head unit-driving circuits 84, which drive the head units 86.

Figure 5:
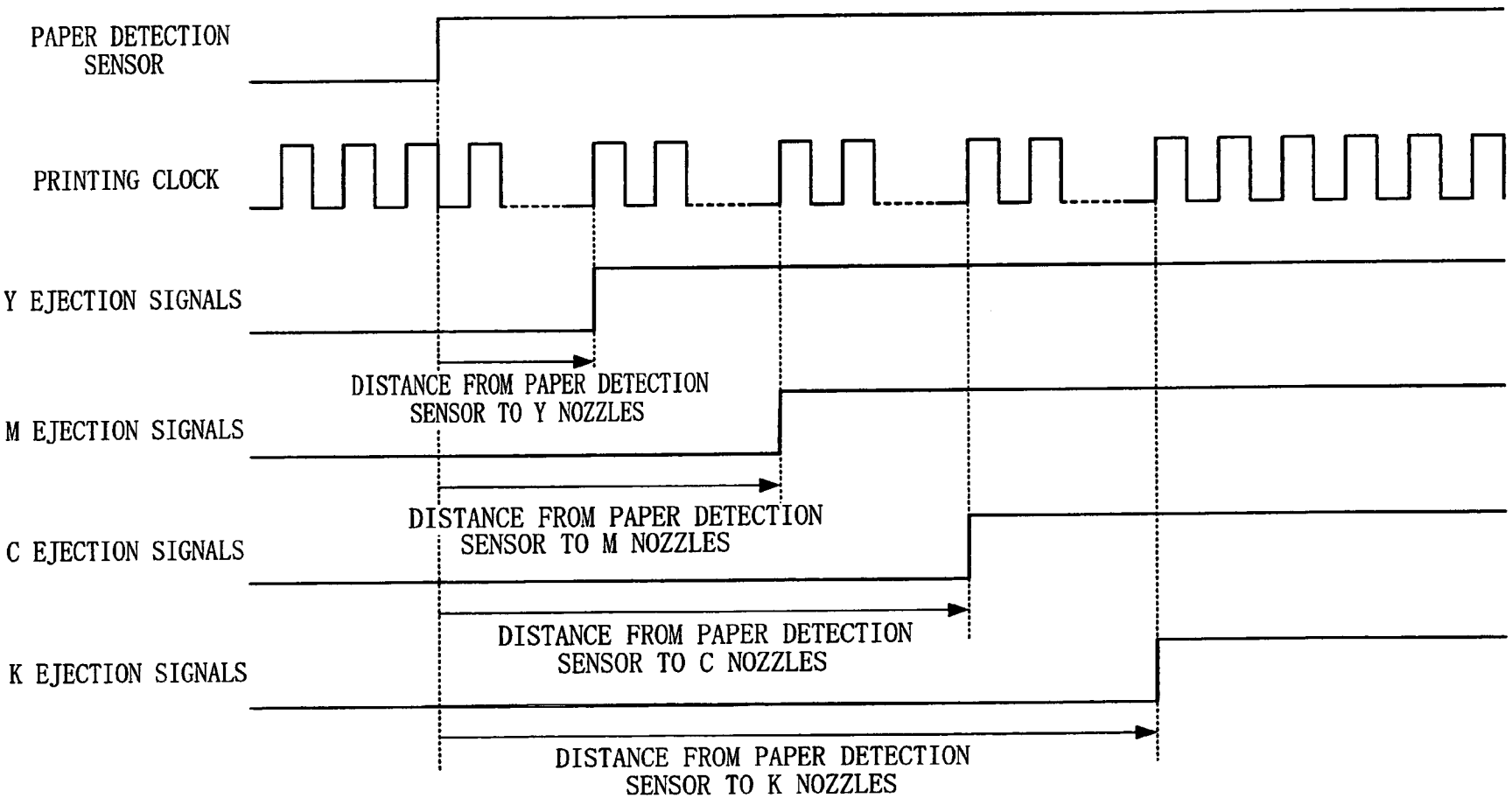
FIG. 5 is a diagram showing printing timings of recording heads of respective colors.

As shown in FIG. 5, the head-driving circuit 80 adjusts printing positions of the respective colors by adjusting printing timings in accordance with distances to the recording heads 12 of the respective colors. More specifically, a distance from detection of the paper P by the paper leading end detection sensor 28 is measured by counting printing clock signals outputted from the print timing sensor 32, and printing of a color is started when a clock count corresponding to the distance of the color is reached.

Each delay circuit 82 compensates for a printing misalignment in the sub-scanning direction due to inclination of the recording head 12 by shifting printing timings for the head units 86, as shown in FIG. 4.

Figure 6:
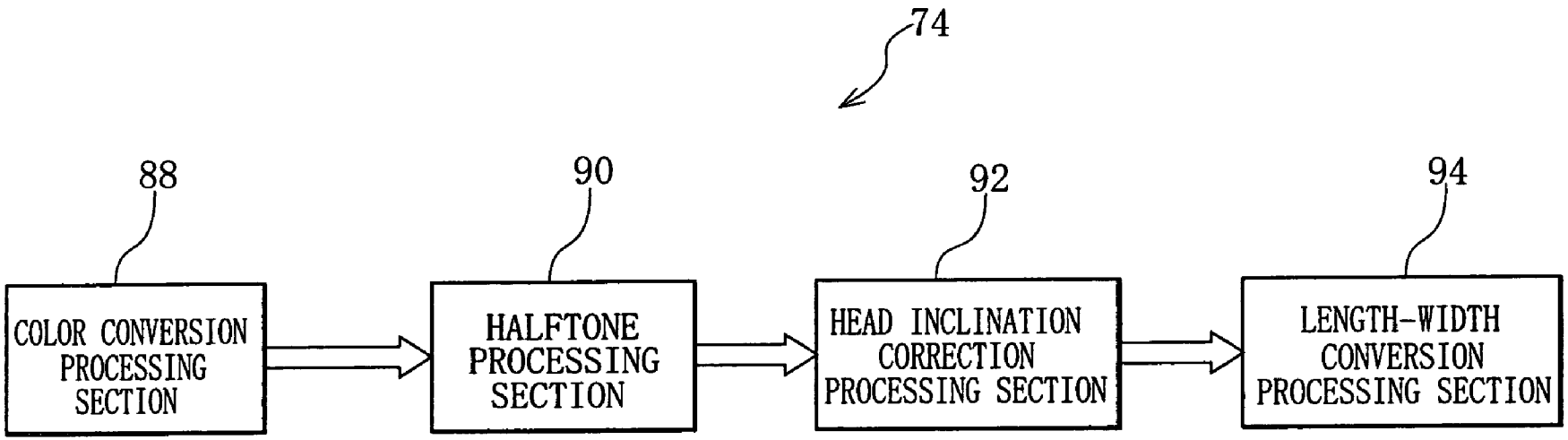
FIG. 6 is a block diagram showing structure of an image processing control circuit of the inkjet printer relating to the first exemplary embodiment of the present invention.

Now, structure of the image processing control circuit 74 relating to the first exemplary embodiment of the present invention will be described in more detail. FIG. 6 is a block diagram showing detailed structure of the image processing control circuit 74.

The image processing control circuit 74 relating to the first exemplary embodiment is structured to include a color conversion processing section 88, a halftone processing section 90, a head inclination correction processing section 92 and a length-width conversion processing section 94.

The color conversion processing section 88 performs color conversion processing from, for example, R (red), G (green), B (blue) printing data to C (cyan), M (magenta), Y (yellow), K (black) printing data, which the inkjet printer 10 can handle. Various previously known technologies can be employed for a color conversion processing method. The color conversion processing section 88 may be omitted if the printing data that is inputted is CMYK printing data.

The halftone processing section 90 carries out processing to convert gradations of the inputted printing data to gradations which can be processed by the inkjet printer 10. In the present exemplary embodiment, there are four kinds of ink droplet size ejected from the recording heads 12—large, medium, small and none—and printing data of 256 gradations is quantized into 4 gradations.

Figure 7:
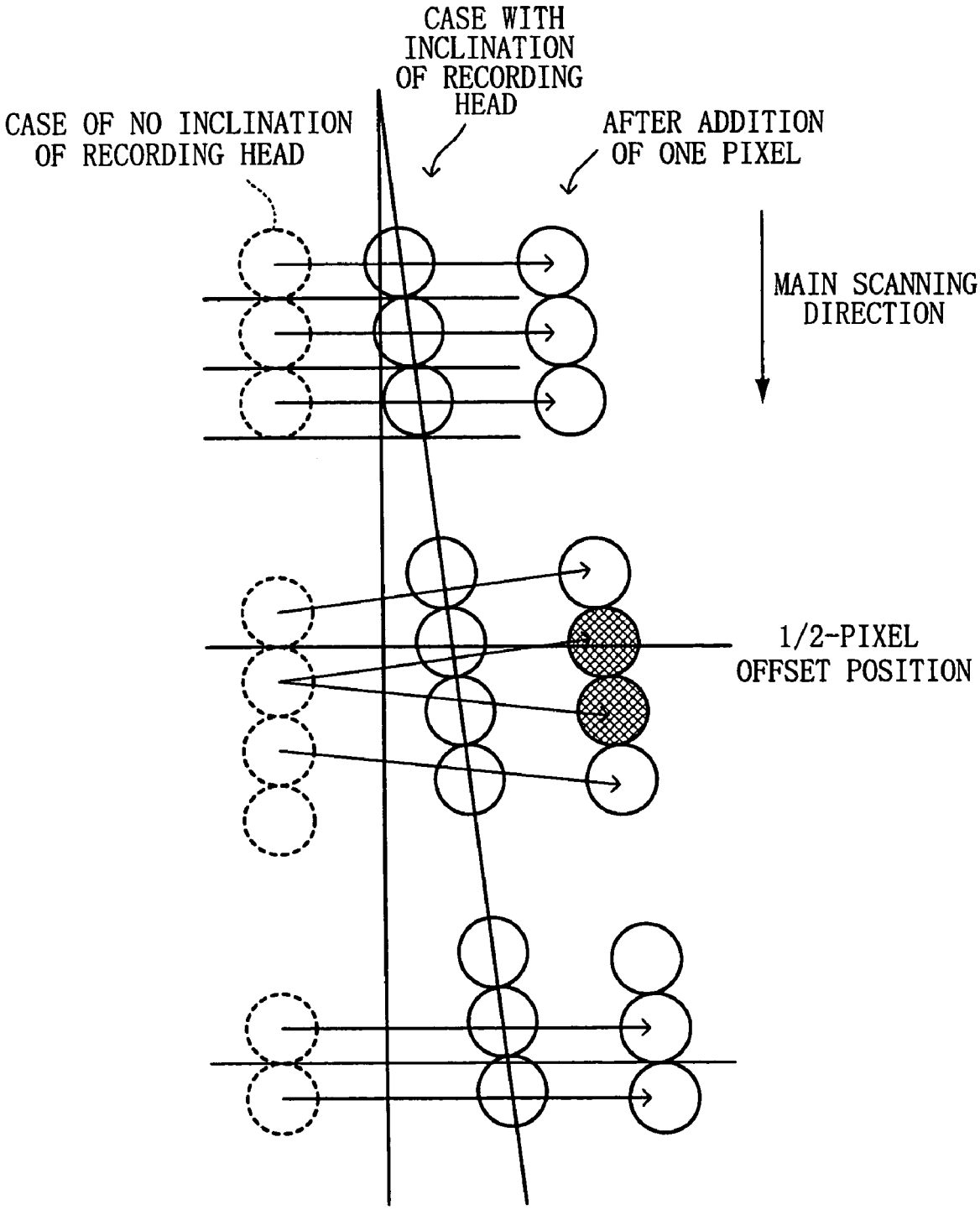
FIG. 7 is a diagram for explaining correction of a main scanning direction image width misalignment due to inclination of a recording head, which is implemented by the image processing control circuit of the inkjet printer relating to the first exemplary embodiment of the present invention.

The head inclination correction processing section 92 performs processing in order to compensate for a reduction in the main scanning direction image width that occurs due to an inclination of the recording head 12 in a case in which the recording head 12, in which the head units 86 are arranged in the direction intersecting the paper conveyance direction, is mounted to be inclined relative to a reference position (a position perpendicular to the paper conveyance direction), which, for the examples in FIGS. 2A and 2B, is a case in which the recording head is mounted to be turned from an intended mounting position with an axis of the turning being a normal direction of the belt surface of the belt 24D at a region thereof that opposes the recording head 12. More specifically, in the present exemplary embodiment, the main scanning direction image width reduction due to the inclination of the recording head 12 is adjusted for by adding (inserting) a new pixel to serve as image data corresponding to a nozzle position at which a dot that would ideally be printed is offset in the main scanning direction by a distance corresponding to a predetermined pixel amount because of the inclination of the recording head 12. To be more precise, as shown in FIG. 7, at a nozzle (nozzle Y) which is next after a nozzle (nozzle X) at which the misalignment amount in the main scanning direction due to the inclination of the recording head 12 corresponds to a position exceeding the distance of the predetermined pixel amount (for example, ½ a pixel), data the same as the data to be printed by nozzle X is added (inserted) to be printed by nozzle Y (the shaded portions in FIG. 7). At this time, nozzles corresponding to data for a main scanning direction downstream side relative to the pixel that is inserted by the insertion of this data are sequentially shifted, and correspondences between the image data and these nozzles are altered. In accordance with the altered image data-nozzle correspondences, processing the same as described above is performed. That is, for data to be printed by the next nozzle after a nozzle at which the misalignment amount in the main scanning direction from a dot position that would ideally be printed corresponds to a position again exceeding the distance of the predetermined pixel amount (for example, ½ a pixel), data the same as the data to be printed by the immediately prior nozzle is added (inserted) and printed, and nozzles corresponding to data at the main scanning direction downstream side relative to this inserted pixel are sequentially shifted. By repeating such processing, main scanning direction offset amounts are kept to no more than approximately the distance corresponding to the predetermined pixel amount (for example, ½ a pixel), and the reduction of the main scanning direction image width is adjusted for.

In a case in which a direction of orientation of the image is a direction intersecting the conveyance direction of the paper, the length-width conversion processing section 94 carries out processing to switch height and width of the image data. That is, ordinarily, printing data is transmitted as data of lines in a direction intersecting the direction of orientation of the image, so the height and width in the printing data are switched in order to match orientations of the image and the paper. However, if the orientation direction of the image matches the conveyance direction of the paper, this height-width conversion processing is omitted.

Next, operation of the inkjet printer 10 relating to the first exemplary embodiment of the present invention, which is structured as described above, will be schematically described.

When a transmission of printing data and a printing request are implemented from a computer or the like, the CPU 40 stores the transmitted printing data at the print image buffer 76 of the recording head control section 70 and, via the input/output control section 50, controls the paper supply system-driving circuit 52 to drive the paper supply system motor 54. As a result, paper P is conveyed along the path 20A from the paper supply section 16 and conveyed to the conveyance body 24.

When the paper P is conveyed onto the conveyance body 24, the CPU 40, via the input/output control section 50, controls the belt-driving circuit 60 to drive the belt conveyance motor 62. As a result, the paper P is conveyed on the conveyance body 24. When the paper P is transferring onto the conveyance body 24, pressing the fore-end portion of the paper P to a roller prevents the paper P from skewing P.

When the paper P starts to be conveyed on the conveyance body 24, the leading end of the paper P is sensed by the paper leading end detection sensor 28. Then, when this detection result is inputted via the input/output control section 50 to the CPU 40, the CPU 40 controls conveyance of the paper P by the conveyance body 24 while controlling the head-driving circuit 80 via the recording head control section 70, to control printing by the recording heads 12. That is, as shown in FIG. 5, printing clock signals from the detection of the leading end of the paper P by the paper leading end detection sensor 28 are counted to control printing timings of the recording heads 12 of the respective colors. Thus, images of the respective colors are superposed on the paper P and a color image is formed. While printing is being carried out by the recording heads 12 of the respective colors, the printing timings of the head unit-driving circuits 84 are controlled by the delay circuits 82 and the inks are ejected from the nozzles. More specifically, timings corresponding to inclinations of the recording heads 12, which were measured at a time of fabrication of the inkjet printer 10, have been pre-stored in the delay circuits 82 or the NVRAMs 72, and printing is controlled in accordance with these timings. Thus, corrections of inclinations of the recording heads 12 are implemented in the printing in a similar manner to related art. By similarly controlling the recording heads 12 of the respective colors in this manner, the printing is carried out with inclinations of the recording heads 12 of the respective colors being compensated for.

Then, the CPU 40, via the input/output control section 50, controls the paper ejection system-driving circuit 56 to drive the paper ejection system motor 58, and thus the paper P on which printing has been carried out by the recording heads 12 is conveyed along the path 20B and ejected to the paper ejection section 18.

Next, for the inkjet printer 10 relating to the first exemplary embodiment of the present invention, a flow of processing of printing data which has been stored to the print image buffer 76 will be described.

Figure 9:
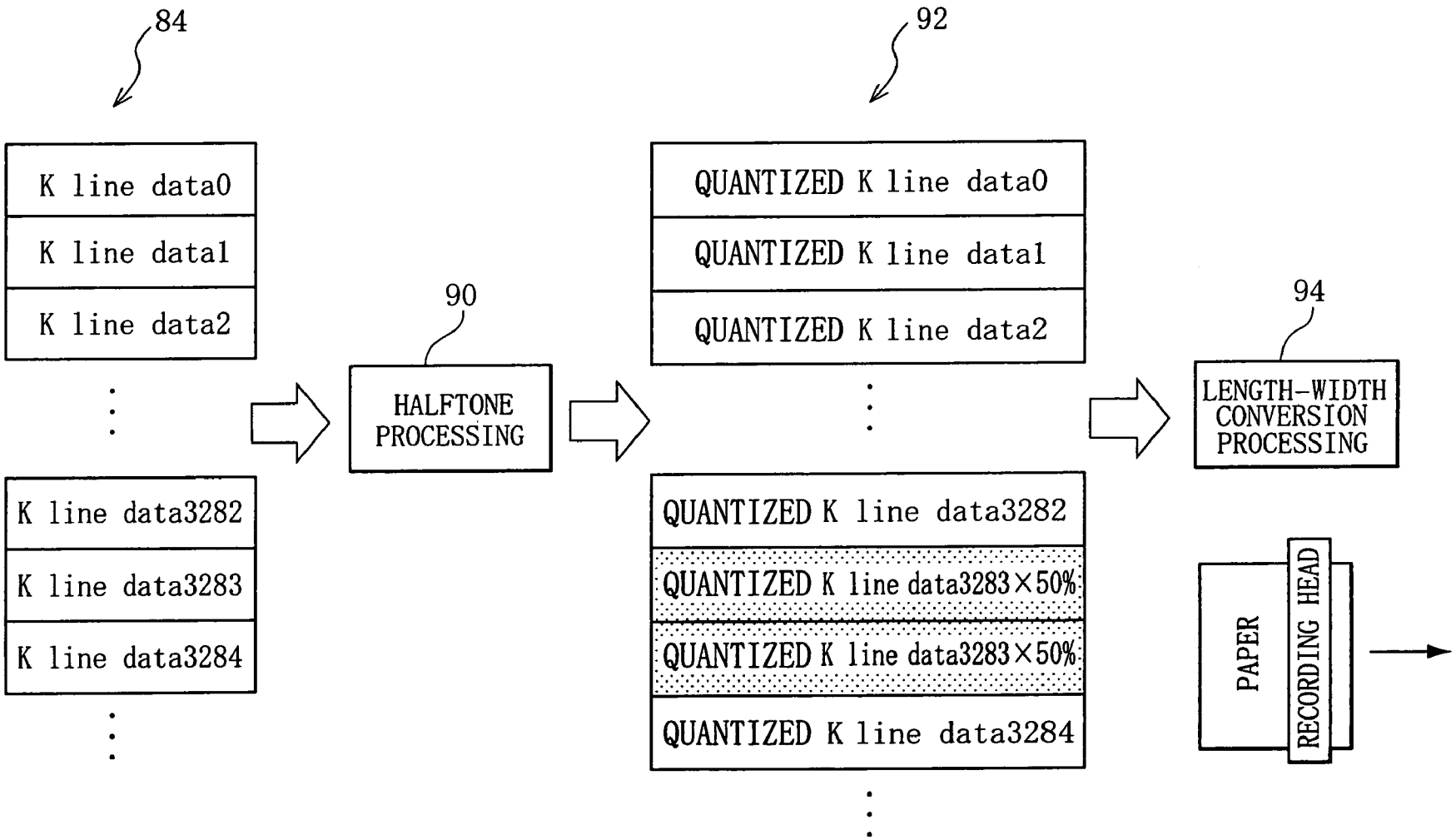
FIG. 9 is a diagram showing a flow of processing of printing data which has been stored at a print image buffer, in the inkjet printer relating to the first exemplary embodiment of the present invention.

When printing data which has been stored at the print image buffer 76 is outputted to the image processing control circuit 74 in response to a processing request, firstly, color conversion to a color space which can be handled by the inkjet printer 10 is carried out by the color conversion processing section 88. After this conversion, for example, printing data for the color K is provided in line units, as shown in FIG. 9.

The printing data which has been subjected to color conversion is converted by the halftone processing section 90 to quantization levels which can be handled by the inkjet printer 10. For example, in a case in which the printing data has 256 gradations and the inkjet printer 10 has 4 gradations—large droplets, medium droplets, small droplets and no droplets—the 256 gradations are converted to 4 values.

For the printing data which has been quantized by the halftone processing section 90, a reduction of the main scanning direction image width which is caused by an inclination of the recording head 12 is corrected by the head inclination correction processing section 92. In the present exemplary embodiment, the inclination of the recording head 12 is measured at a time of fabrication of the inkjet printer 10 and a measurement result is pre-stored in the NVRAM 72. For example, an inclination angle to the design position of the recording head 12 may be memorized in the NVRAM 72, or identification numbers of nozzles corresponding to positions at which main scanning direction misalignments due to the inclination of the recording head 12 are offset by a predetermined pixel amount (for example, a ½-pixel) as shown in FIG. 4 may be memorized. Hence, in the present exemplary embodiment, in accordance with the inclination of the recording head 12 which has been memorized at the NVRAM 72, the head inclination correction processing section 92 inserts additional printing data the same as the corresponding pixels at the positions which are offset by the predetermined pixel amount (for example, ½ a pixel). Thus, the head inclination correction processing section 92 compensates for the main scanning direction image width reduction caused by the inclination of the recording head 12.

For example, in a case in which the recording head 12 has 8,000 nozzles at 600 dpi and an inclination of the recording head 12 is 1°, an offset in the main scanning direction relative to a case in which the recording head 12 is not inclined is approximately 51 μm at the 8,000th dot ($8000\times25.4/600\times(1-\cos 1°)=0.05158057$). Therefore, in the present exemplary embodiment, the head inclination correction processing section 92 performs control so as to insert additional printing data such that a nozzle, which corresponds to the next pixel after a nozzle that corresponds to a position at which the misalignment in the main scanning direction due to the inclination of the recording head 12 as described above is the predetermined pixel amount offset (for example, ½ a pixel), also prints the data that is to be printed by the nozzle corresponding to the position at which the main scanning direction misalignment is the predetermined pixel amount offset. In the case of the example described above, a nozzle at a ½-pixel offset position is the 3,283rd nozzle. Therefore, the printing data is altered such that data that is to be printed by the 3,283rd nozzle is printed by both the 3,283rd nozzle and the 3,284th nozzle. Hence, correspondences of printing data and nozzles are altered such that correspondences between printing data and nozzle numbers are sequentially shifted by one pixel. That is, as shown by the hatching in FIG. 9, one pixel is added at the main scanning direction ½-pixel offset, and thus the reduction of the main scanning direction image width is suppressed. In the case of the example described above, because of the addition of one pixel, the main scanning direction misalignment is zero at the 6,566th pixel, and the main scanning direction image width reduction is suppressed.

For the printing data in which the main scanning direction image width reduction caused by the head inclination has been corrected for by the head inclination correction processing section 92, width and height of the printing data are switched by the length-width conversion processing section 94. That is, ordinarily, printing data is transmitted as data lines in a direction intersecting an orientation direction of an image, and the height and width of the printing data are switched in order to match the orientations of the image and the paper. However, if the orientation direction of the image and the conveyance direction of the paper already match, height-width switching processing is omitted.

First Variant Example Relating to the First Exemplary Embodiment

Now, a first variant example relating to the first exemplary embodiment will be described. In this first variant example, singling processing is carried out such that, at two lines which are printed with the same data in the first exemplary embodiment, a printing ratio of the two lines is 100%. The singling processing is carried out by, for example, performing checker board pattern printing or using a random filter such that the printing ratio of the lines printed with the same data is 100%. For example, FIG. 8A shows an example of a random filter 96 for making a printing ratio of two lines which are printed with matching data 100%.

Figure 8A:
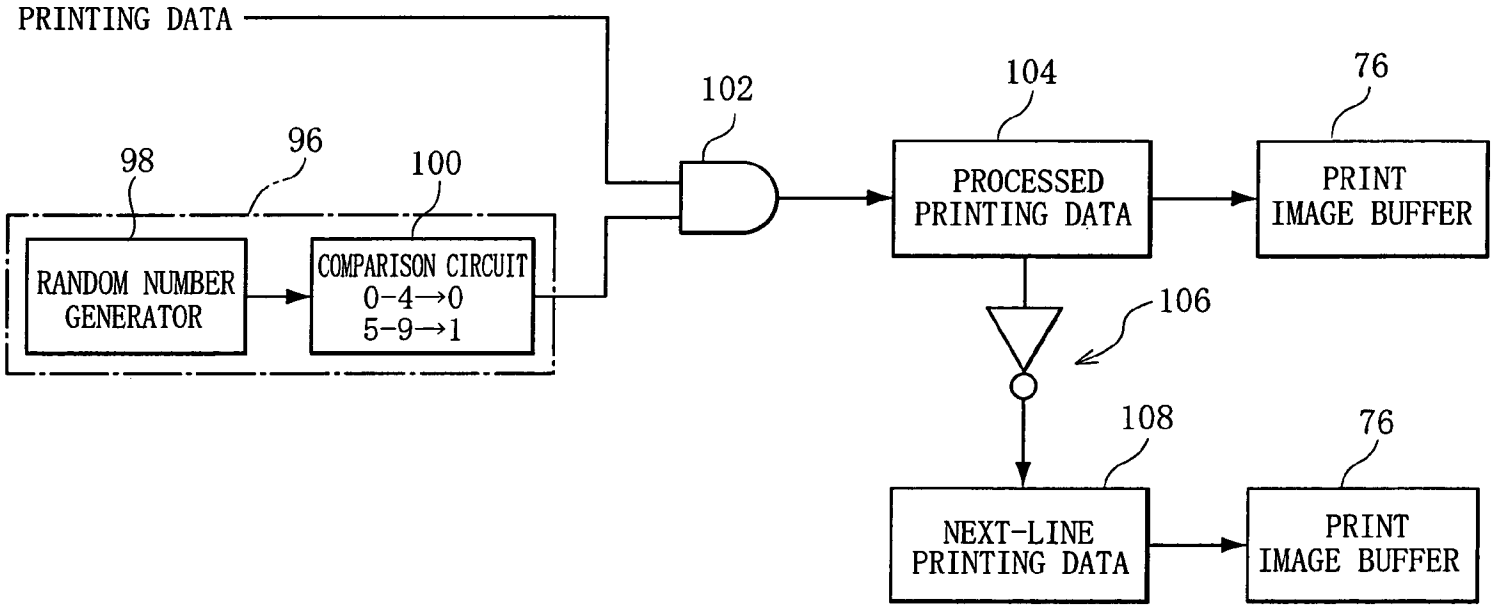
FIG. 8A is a block diagram showing an example of a random filter in a first variant example relating to the first exemplary embodiment of the present invention.

In the random filter 96 of FIG. 8A, random numbers from 0 to 9 are generated by a random number generator 98. A comparison circuit 100 is provided, which outputs a zero, representing no printing, when a value generated by the random number generator 98 is 0 to 4 and outputs a one, representing printing, when the value is 5 to 9. Printing data and comparison results from the comparison circuit 100 are inputted to the AND circuit 102, and outputs of the AND circuit 102 are stored in the print image buffer 76 as processed printing data 104. Meanwhile, for a next line, the processed printing data is inverted by an inversion circuit 106, and the inverted data is stored in another of the print image buffer 76 as next-line printing data 108. Thus, lines which are printed with the above-mentioned matching data have a printing ratio of 100%.

Accordingly, in the example of the first exemplary embodiment, the two lines which are printed by the 3,283rd and 3,284th nozzles are altered such that a printing ratio thereof is 100%.

Second Variant Example Relating to the First Exemplary Embodiment

Figure 8B:
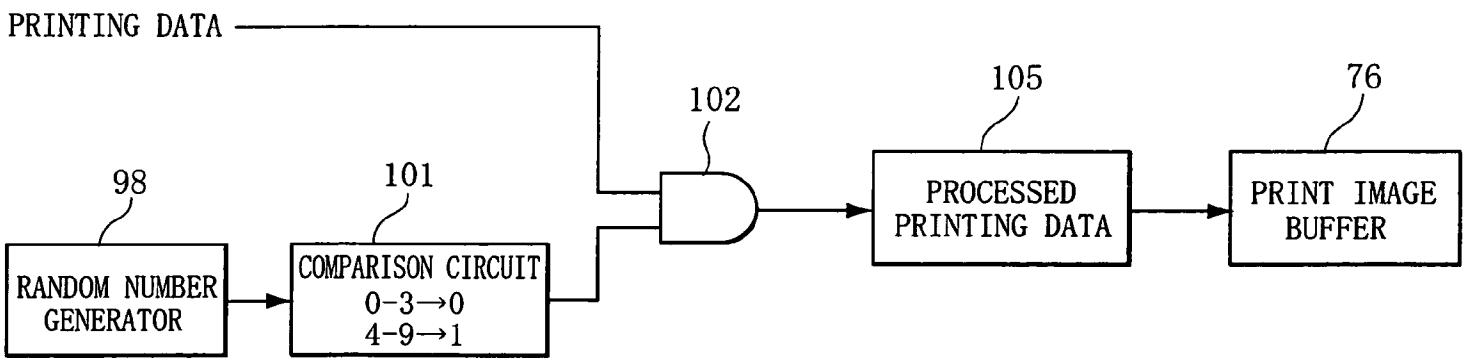
FIG. 8B is a diagram showing a second variant example relating to the first exemplary embodiment of the present invention.

Next, a second variant example relating to the first exemplary embodiment will be described. The second variant example is a further variant of the first variant example. In the second variant example, the printing ratio is set to a value between 100% (50% singling) and 200% (no singling), in accordance with paper quality or the like. For example, as shown in FIG. 8B, a comparison circuit 101 is provided. When the value of a random number from 0 to 9 generated by the random number generator 98 is 0 to 3, the comparison circuit 101 outputs a zero representing no printing, and when the value is 4 to 9, the comparison circuit 101 outputs a one representing printing. The printing data and the comparison results from the comparison circuit 101 are inputted to the AND circuit 102, and outputs of the AND circuit 102 are stored in the print image buffer 76 as processed printing data 105. This processing is carried out separately for each of the two lines, and thus the printing ratio can be set to 120%.

Second Exemplary Embodiment

Next, an inkjet printer relating to a second exemplary embodiment of the present invention will be described. The inkjet printer relating to the second exemplary embodiment differs from the first exemplary embodiment only in structure of the image processing control circuit 74. Therefore, only the image processing control circuit 74 will be described.

In the first exemplary embodiment, when a dot that would ideally be printed is offset by a predetermined pixel amount in the main scanning direction due to inclination of the recording head 12, a pixel with data the same as data corresponding to the position that is offset by the predetermined pixel amount is added, and two lines with same data is formed such that a printing ratio is 100%. Thus, the main scanning direction image width reduction caused by the inclination of the recording head 12 is adjusted for. In the second exemplary embodiment, however, where a dot that would ideally be printed is shifted by a predetermined pixel amount in the main scanning direction due to inclination of the recording head 12, one pixel of blank data is added, and sizes of dots that are printed by nozzles before and after the added blank data are set so as to be printed as dots larger than the sizes of dots that would ideally be printed thereat. Thus, the main scanning direction image width reduction caused by the inclination of the recording head 12 is adjusted for.

Figure 10:
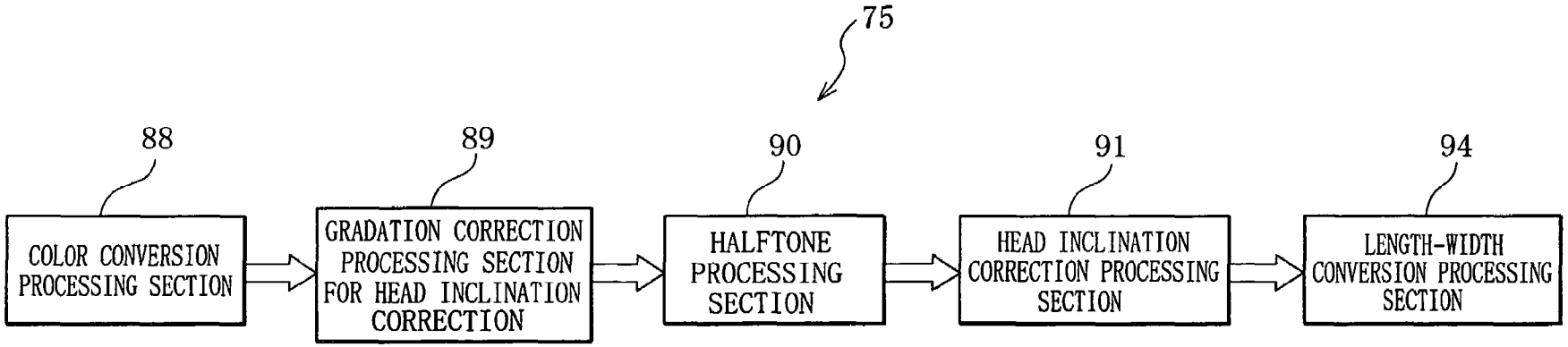
FIG. 10 is a block diagram showing structure of an image processing control circuit of an inkjet printer relating to a second exemplary embodiment of the present invention.

FIG. 10 is a block diagram showing structure of an image processing control circuit 75 of the inkjet printer relating to the second exemplary embodiment of the present invention. In this description, structures that are the same as in the first exemplary embodiment are assigned the same reference numerals.

The image processing control circuit 75 relating to the second exemplary embodiment is structured to include the color conversion processing section 88, a gradation correction processing section for head inclination correction 89, the halftone processing section 90, a head inclination correction processing section 91 and the length-width conversion processing section 94.

Similarly to the first exemplary embodiment, the color conversion processing section 88 performs color conversion processing from, for example, R (red), G (green), B (blue) printing data to C (cyan), M (magenta), Y (yellow), K (black) printing data, which can be handled by the inkjet printer 10. Various previously known technologies can be employed as a color conversion processing method. The color conversion processing section 88 may be omitted if the printing data that is inputted is CMYK printing data.

At the gradation correction processing section for head inclination correction 89, processing is carried out in order to convert dot sizes which are printed by nozzles before and after the above-mentioned blank data. In the present exemplary embodiment, from 256 gradations of printing data, the inkjet printer 10 has four gradations—large droplets, medium droplets, small droplets and no droplets. The dot sizes are converted by adding the value 64 to the printing data for which dot sizes are to be converted.

Similarly to the first exemplary embodiment, the halftone processing section 90 carries out processing to convert the gradations of the inputted printing data to the gradations which can be processed by the inkjet printer 10. In the present exemplary embodiment, with the four kinds of ink droplet size ejected from the recording head 12—large, medium, small and none—the printing data of 256 gradations is quantized into 4 gradations.

Figure 11:
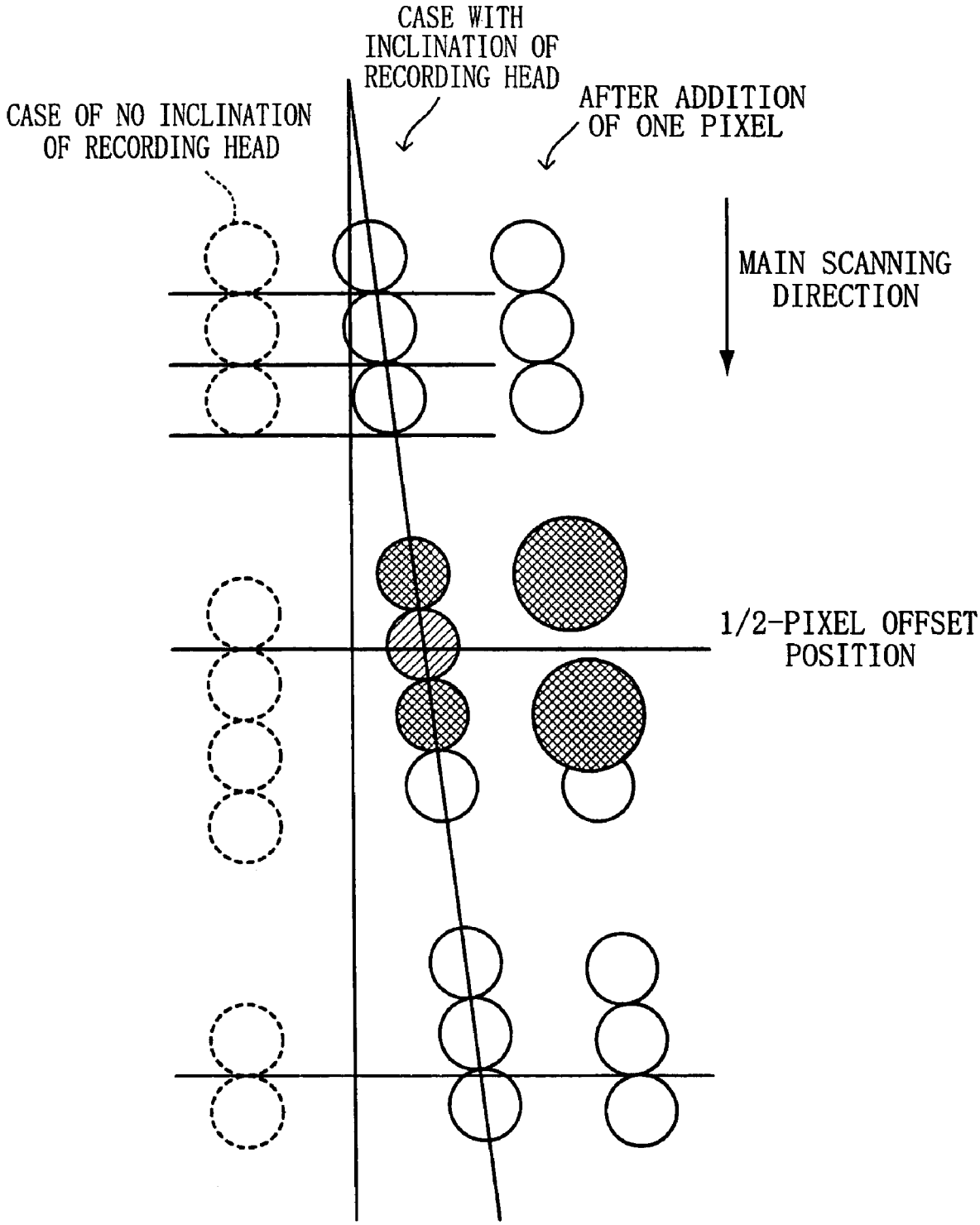
FIG. 11 is a diagram for explaining correction of a main scanning direction image width misalignment due to inclination of a recording head, which is implemented by the image processing control circuit of the inkjet printer relating to the second exemplary embodiment of the present invention.

The head inclination correction processing section 91 performs processing in order to compensate for a reduction in the main scanning direction image width due to an inclination of the recording head 12 in a case in which the recording head, in which the head units 86 are arranged in the direction intersecting the paper conveyance direction, is mounted to be inclined relative to a reference position (a position perpendicular to the paper conveyance direction). More specifically, in the present exemplary embodiment, where a dot that would ideally be printed is offset by the predetermined pixel amount in the main scanning direction due to the inclination of the recording head 12, the main scanning direction image width reduction which is caused by the inclination of the recording head 12 is adjusted for by adding one pixel. To be more precise, as shown in FIG. 11, blank data is added at a position at which the misalignment in the main scanning direction due to the inclination of the recording head 12 offsets by the predetermined pixel amount (for example, ½ a pixel). Then, the sizes of dots that are to be printed by nozzles corresponding to dots which are adjacent to the dot at which this blank data has been inserted are printed as dots with sizes larger than the sizes that would ideally be printed. At this time, processing is performed to sequentially shift the nozzles that correspond to data in accordance with the insertion of the blank data.

Next, for the inkjet printer 10 relating to the second exemplary embodiment of the present invention, a flow of processing of printing data which has been stored to the print image buffer 76 will be described.

Figure 12:
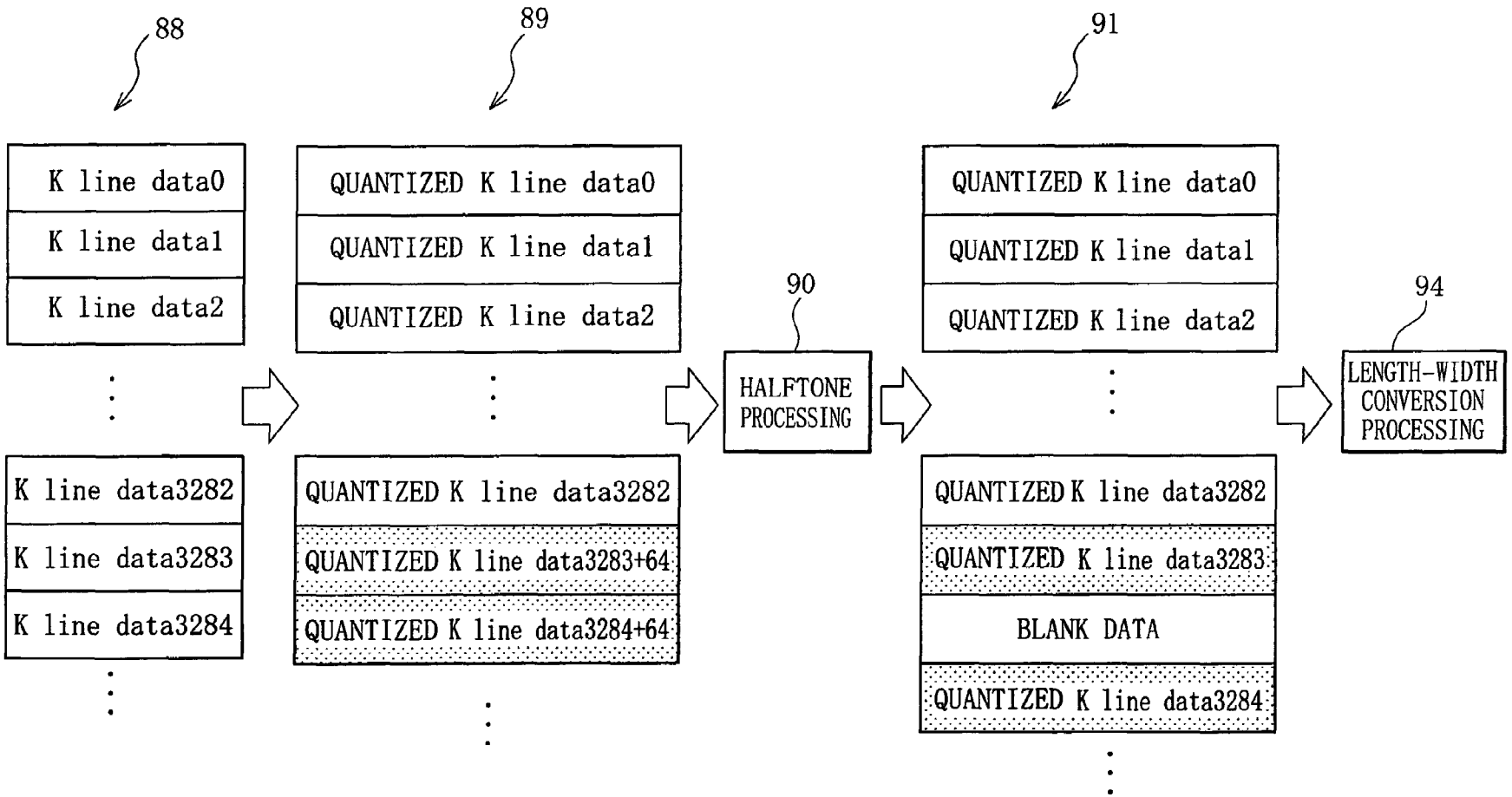
FIG. 12 is a diagram showing a flow of processing of printing data which has been stored at a print image buffer, in the inkjet printer relating to the second exemplary embodiment of the present invention.

Similarly to the first exemplary embodiment, when printing data which has been stored at the print image buffer 76 is outputted to the image processing control circuit 75 in response to a processing request, firstly, color conversion to the color space that can be handled by the inkjet printer 10 is carried out by the color conversion processing section 88. After this conversion, for example, printing data for the color K is provided in line units, as shown in FIG. 12.

The printing data which has been processed to color conversion is subjected to processing by the gradation correction processing section for head inclination correction 89, in order to convert the sizes of dots to be printed by nozzles before and after the blank data that is to be inserted by the head inclination correction processing section 91. More specifically, the position of an offset by the predetermined pixel amount (for example, ½ a pixel) in the main scanning direction is determined on the basis of the inclination of the recording head 12 stored in the NVRAM 72, and gradations thereat are adjusted by adding a predetermined value to values of printing data corresponding to that position and the next line. Thus, the printing dot sizes are converted. For example, in a case in which the recording head 12 has 8,000 nozzles at 600 dpi, if the inclination of the recording head 12 is 1°, a misalignment in the main scanning direction of approximately 51 μm, relative to a case in which the recording head 12 is not inclined, occurs at the 8,000th dot. Therefore, as shown by the hatched portions in FIG. 12, 64 is added to values of printing data to be printed by the nozzle corresponding to the 3,283rd line, which is the position at which the main scanning direction misalignment caused by the inclination of the recording head 12 is offset by the predetermined pixel amount (for example, ½ a pixel), and the nozzle of the adjacent 3,284th line. Thus, the dot sizes are altered.

The printing data which has been processed by the gradation correction processing section for head inclination correction 89 is converted by the halftone processing section 90 to the quantization levels that can be handled by the inkjet printer 10. For example, in a case in which the printing data has 256 gradations and the inkjet printer 10 has 4 gradations—large droplets, medium droplets, small droplets and no droplets—the 256 gradations are converted to 4 values.

For the printing data which has been quantized by the halftone processing section 90, a reduction of the main scanning direction image width which is caused by an inclination of the recording head 12 is corrected by the head inclination correction processing section 91. In the present exemplary embodiment, as shown in FIG. 12, blank data is added between the lines whose gradations have been adjusted by the gradation correction processing section for head inclination correction 89. Thus, the main scanning direction image width reduction caused by the inclination of the recording head 12 is corrected for. As a result, similarly to the first exemplary embodiment, the main scanning direction image width reduction is suppressed by the addition of individual lines.

For the printing data in which the main scanning direction image width reduction caused by the head inclination has been compensated for by the head inclination correction processing section 91, similarly to the first exemplary embodiment, width and height of the printing data are switched by the length-width conversion processing section 94. That is, ordinarily, printing data is structured by data of lines in a direction intersecting an orientation direction of an image, and the height and width of the printing data are switched in order to match the orientations of the image and the paper. However, if the orientation direction of the image and the conveyance direction of the paper already match, the height-width switching processing is omitted.

First Variant Example Relating to the Second Exemplary Embodiment

In the second exemplary embodiment, the sizes of dots to be printed by nozzles before and after blank data are printed as dots larger than dot sizes that would ideally be printed. In a first variant example relating to the second exemplary embodiment, however, only one of the dots to be printed by the nozzles before and after the blank data is printed with a dot size larger than the dot size that would ideally be printed. For example, only the dot printed by the nozzle after the blank data is printed as a dot with a size larger than the dot size that would ideally be printed. Further, which printing nozzle's dot is to be larger than the dot size that would ideally be printed may be altered in the main scanning direction for each main scanning line.

Second Variant Example Relating to the Second Exemplary Embodiment

If stripes due to blank data will not be conspicuous, in cases in which a main scanning direction resolution is high or the like, the processing by the gradation correction processing section for head inclination correction 89 in the second exemplary embodiment may be omitted. In such a case, the processing to increase the sizes of dots that are printed by the nozzles before and after the blank data is not performed.

Anyway, in the exemplary embodiments described above, a recording head featuring a printing width that matches or exceeds a paper width has been employed as the recording head 12 of the inkjet printer 10. However, this is not a limitation; recording heads which perform main scanning by being moved in a direction intersecting the conveyance direction of the paper are also applicable.

Further, in the exemplary embodiments described above, an inkjet printer has been described as an example of the droplet ejection apparatus, but this is not a limitation. Application is also possible to other droplet ejection devices such as, for example, pattern-forming devices which eject droplets onto sheet-like substrates other than paper in order to form patterns of conductors, liquid crystal display elements and the like, and so forth.

Further, in the exemplary embodiments described above, image data is altered such that a single pixel is added at a location at which an offset of at least ½ a pixel of an ejection resolution occurs, as an example. However, single pixel addition locations are not limited to ejection resolution ½-pixels and could be, for example, positions which are offset by more than ½ a pixel, and may be suitably specified.

Figure 13:
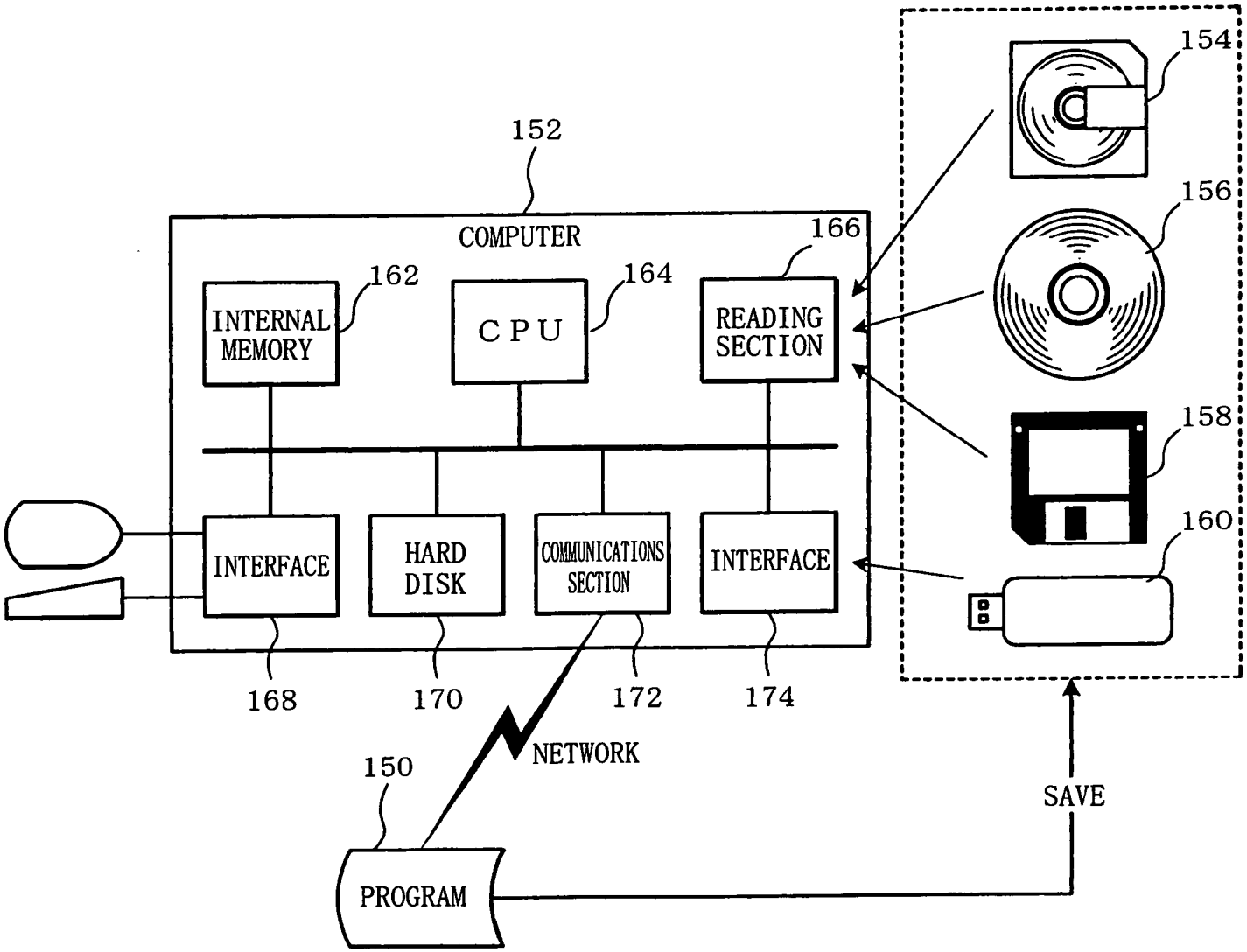
FIG. 13 is an explanatory view of an example of a computer program, storage mediums storing the computer program, and a computer, for a case in which the computer program executes the functions of a head inclination correction processing section.

Further, in the exemplary embodiments described above, the head inclination correction processing sections 92 and 91 of the image processing control circuit 74 have been described as hardware structures, but could be software structures. For example, FIG. 13 is an explanatory view of an example of a computer program, storage mediums storing the computer program, and a computer, for a case in which the computer program executes the functions of the head inclination correction processing section 92 or 91. In this drawing, 150 is the program, 152 is the computer, 154 is a magneto-optical disc, 156 is an optical disc, 158 is a magnetic disk, 160 is a memory, 162 is an internal memory, 166 is a reading section, 170 is a hard disk, 168 and 174 are interfaces, and 172 is a communications section.

Some or all of sections of a droplet ejection device of the present invention which is described by the above embodiments may be realized by the program 150 which is executable by a computer (for example, a computer provided at an inkjet printer). In such a case, the program 150, data that is used by the program and suchlike can be stored at a storage medium which is readable by the computer. The storage medium is a medium which can induce energy-change states of magnetism, light, electricity or the like in accordance with descriptions of the program at the reading section 166, which is provided at a hardware resource of the computer, and propagate the descriptions of the program to the reading section 166 with a format of signals corresponding to the energy changes. For example, the storage medium is the magneto-optical disk 154, the optical disk 156 (a CD, a DVD or the like), the magnetic disk 158, the memory 160 (an IC card, a memory card or the like) or the like. Naturally, the storage medium is not limited to being portable.

The program 150 is saved to the storage medium. Then, the storage medium is mounted to the reading section 166 or the interface 174 of the computer 152, and the program 150 is accordingly read out through the computer and stored in the internal memory 162 or the hard disk 170. The program 150 is executed by a CPU 164 and can realize the functions of the droplet ejection device of the present invention. Alternatively, the program 150 may be transferred to the computer 152 via a network or the like, the program 150 being received at the computer 152 by the hard disk 170 and being memorized at the internal memory 162 or the hard disk 170, and the functions of the droplet ejection device of the present invention being realized by the program 150 being executed by the CPU 164. The computer 152 may also be connected with various other devices via the interface 168, and is connected with, for example, a display device which displays information, an input device at which a user inputs information, and the like.

Naturally, it is also possible for a portion of the functions to be constituted by hardware or for all to be constituted by hardware. Further, it is possible to constitute a program which includes the present invention together with other structures.

A droplet ejection device of a first aspect of the present invention includes: a head at which a plurality of nozzles, which eject droplets in accordance with image data representing an image, are arrayed over a width in a main scanning direction which is longer than a recording region width, the head forming a main scanning line with the droplets ejected from the nozzles; a memorization component at which inclination information relating to an inclination of the main scanning line formed by the head with respect to a main scanning line that should ideally be formed is pre-memorized; and an alteration component that, in accordance with the inclination information memorized at the memorization component, alters which nozzles are to eject droplets in accordance with the image data.

In a second aspect of the present invention, the alteration component of the first aspect alters which nozzles are to eject droplets by altering the image data, so as to insert predetermined image data to serve as the image data that corresponds to a nozzle neighboring a nozzle at which an offset amount of a nozzle position in the main scanning direction from an ideal nozzle position, which offset is caused by the inclination, is at least ½ of an ejection resolution amount in the main scanning direction.

In a third aspect of the present invention, in the second aspect, no-droplet data, for not ejecting a droplet, is inserted as the predetermined image data.

In a fourth aspect, the alteration component of the third aspect further alters the image data corresponding to at least one of nozzles neighboring the nozzle corresponding to the no-droplet data, such that a droplet diameter at the at least one nozzle is larger than a droplet diameter that should ideally be ejected.

In a fifth aspect, the alteration component of the second aspect inserts, as the image data that corresponds to the nozzle neighboring the nozzle at which the offset of the nozzle position in the main scanning direction from the ideal nozzle position, which offset is caused by the inclination, is at least ½ of the ejection resolution amount, a value the same as a value of the image data of the nozzle corresponding to the position at which the offset of at least ½ occurs.

In a sixth aspect, the alteration component of the fifth aspect adjusts the image data corresponding to two lines, which are formed by droplets ejected from the nozzle corresponding to the position at which the offset of at least ½ occurs and the nozzle at which the same value is added, such that a printing ratio of the two lines is 100% or more.

A droplet ejection device control method of a seventh aspect: pre-memorizes, at a memorization component that memorizes inclination information relating to an inclination, an inclination of a main scanning line formed by a head, at which a plurality of nozzles which eject droplets in accordance with image data representing an image are arrayed over a width in a main scanning direction which is longer than a recording region width, the head forming the main scanning line with the droplets ejected from the nozzles, with respect to a main scanning line that should ideally be formed; in accordance with the inclination information memorized at the memorization component, alters which nozzles are to eject droplets in accordance with the image data; and ejects the droplets from the nozzles of the recording head.

In an eighth aspect, processing is executed at a computer for: in accordance with inclination information that has been pre-memorized at a memorization component that memorizes inclination information relating to an inclination of a main scanning line formed by a head, at which a plurality of nozzles which eject droplets in accordance with image data representing an image are arrayed over a width in a main scanning direction which is longer than a recording region width, the head forming the main scanning line with the droplets ejected from the nozzles, with respect to a main scanning line that should ideally be formed, alters which nozzles are to eject droplets in accordance with the image data; and ejects the droplets from the nozzles of the recording head for forming the image.

What is claimed is:

1. A droplet ejection device comprising:

a head at which a plurality of nozzles, which eject droplets in accordance with image data representing an image, are arrayed over a width in a main scanning direction which is longer than a recording region width, the head forming a main scanning line with the droplets ejected from the nozzles;

a storage component at which inclination information relating to an inclination of the main scanning line formed by the head with respect to a main scanning line that should ideally be formed is pre-stored; and an alteration component that, in accordance with the inclination information stored at the storage component, alters which nozzles are to eject droplets in accordance with the image data.

2. The droplet ejection device of claim 1, wherein the alteration component alters which nozzles are to eject droplets by altering the image data, so as to insert predetermined image data to serve as the image data that corresponds to a nozzle neighboring a nozzle at which an offset amount of a nozzle position in the main scanning direction from an ideal nozzle position, which offset is caused by the inclination, is at least ½ of an ejection resolution amount in the main scanning direction.

3. The droplet ejection device of claim 2, wherein the alteration component inserts no-droplet data, for not ejecting a droplet, as the predetermined image data.

4. The droplet ejection device of claim 3, wherein the alteration component further alters the image data corresponding to at least one of nozzles neighboring the nozzle corresponding to the no-droplet data, such that a droplet diameter is larger than a droplet diameter that should ideally be ejected.

5. The droplet ejection device of claim 2 wherein, as the image data that corresponds to the nozzle neighboring the nozzle at which the offset of the nozzle position in the main scanning direction from the ideal nozzle position, which offset is caused by the inclination, is at least ½ of the ejection resolution amount, the alteration component inserts a value the same as a value of the image data of the nozzle corresponding to the position at which the offset of at least ½ occurs.

6. The droplet ejection device of claim 5, wherein the alteration component adjusts the image data corresponding to two lines, which are formed by droplets ejected from the nozzle at which the same value is added and the nozzle corresponding to the position at which the offset of at least ½ occurs, such that a printing ratio of the two lines is 100% or more.

7. A method of controlling a droplet ejection device, the droplet ejection device including:

a head at which a plurality of nozzles, which eject droplets in accordance with image data representing an image, are arrayed over a width in a main scanning direction which is longer than a recording region width, the head forming a main scanning line with the droplets ejected from the nozzles, the control method comprising:

(a) pre-storing inclination information relating to an inclination of the main scanning line formed by the head with respect to a main scanning line that should ideally be formed; and (b) in accordance with the stored inclination information, altering which nozzles are to eject droplets in accordance with the image data.

8. The method of claim 7, wherein, in (b), altering which nozzles are to eject droplets by altering the image data, so as to insert predetermined image data to serve as the image data that corresponds to a nozzle neighboring a nozzle at which an offset amount of a nozzle position in the main scanning direction from an ideal nozzle position, which offset is caused by the inclination, is at least ½ of an ejection resolution amount in the main scanning direction.

9. The method of claim 8, wherein, in (b), inserting no-droplet data, for not ejecting a droplet, as the predetermined image data.

10. The method of claim 9, wherein, in (b), further altering the image data corresponding to at least one of nozzles neighboring the nozzle corresponding to the no-droplet data, such that a droplet diameter is larger than a droplet diameter that should ideally be ejected.

11. The method of claim 8, wherein, in (b), inserting, as the image data that corresponds to the nozzle neighboring the nozzle at which the offset of the nozzle position in the main scanning direction from the ideal nozzle position, which offset is caused by the inclination, is at least ½ of the ejection resolution amount, a value the same as a value of the image data of the nozzle corresponding to the position at which the offset of at least ½ occurs.

12. The method of claim 11, wherein, in (b), adjusting the image data corresponding to two lines, which are formed by droplets ejected from the nozzle at which the same value is added and the nozzle corresponding to the position at which the offset of at least ½ occurs, such that a printing ratio of the two lines is 100% or more.

13. A storage medium readable by a computer, the storage medium storing a program of instructions executable by the computer to perform a function for controlling a droplet ejection device, the droplet ejection device including:

a head at which a plurality of nozzles, which eject droplets in accordance with image data representing an image, are arrayed over a width in a main scanning direction which is longer than a recording region width, the head forming a main scanning line with the droplets ejected from the nozzles, the function comprising the steps of:

(a) pre-storing inclination information relating to an inclination of the main scanning line formed by the head with respect to a main scanning line that should ideally be formed; and (b) in accordance with the stored inclination information, altering which nozzles are to eject droplets based on the image data.

14. The storage medium of claim 13, wherein, in (b), altering which nozzles are to eject droplets by altering the image data, so as to insert predetermined image data to serve as the image data that corresponds to a nozzle neighboring a nozzle at which an offset amount of a nozzle position in the main scanning direction from an ideal nozzle position, which offset is caused by the inclination, is at least ½ of an ejection resolution amount in the main scanning direction.

15. The storage medium of claim 14, wherein, in (b), inserting no-droplet data, for not ejecting a droplet, as the predetermined image data.

16. The storage medium of claim 15, wherein, in (b), further altering the image data corresponding to at least one of nozzles neighboring the nozzle corresponding to the no-droplet data, such that a droplet diameter is larger than a droplet diameter that should ideally be ejected.

17. The storage medium of claim 14, wherein, in (b), inserting, as the image data that corresponds to the nozzle neighboring the nozzle at which the offset of the nozzle position in the main scanning direction from the ideal nozzle position, which offset is caused by the inclination, is at least ½ of the ejection resolution amount, a value the same as a value of the image data of the nozzle corresponding to the position at which the offset of at least ½ occurs.

18. The storage medium of claim 17, wherein, in (b), adjusting the image data corresponding to two lines, which are formed by droplets ejected from the nozzle at which the same value is added and the nozzle corresponding to the position at which the offset of at least ½ occurs and the nozzle, such that a printing ratio of the two lines is 100% or more.

* * * * *